US006226837B1

(12) United States Patent
Leder et al.

(10) Patent No.: US 6,226,837 B1
(45) Date of Patent: May 8, 2001

(54) GEARING FOR JOINTLY DRIVING FLAT BARS AND A FLAT BAR CLEANING DEVICE OF A CARDING MACHINE

(75) Inventors: Armin Leder; Helmut Mösges, both of Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/409,984

(22) Filed: Sep. 30, 1999

(30) Foreign Application Priority Data

Sep. 30, 1998 (DE) ..... 198 44 790

(51) Int. Cl.[7] ..... D01G 15/76
(52) U.S. Cl. ..... 19/111; 19/102
(58) Field of Search ..... 19/98, 99, 102, 19/103, 104, 107, 108, 109, 110, 111, 115 B, 218, 263; 15/256.53, 256.51

(56) References Cited

U.S. PATENT DOCUMENTS

| | | | | |
|---|---|---|---|---|
| 3,529,326 | * | 9/1970 | Nutter et al. | 19/111 |
| 3,604,061 | * | 9/1971 | King, Jr. | 19/111 |
| 3,678,538 | * | 7/1972 | Sloan | 19/107 |
| 4,276,677 | * | 7/1981 | Piske | 19/111 |
| 4,321,731 | | 3/1982 | Kott . | |
| 4,368,561 | * | 1/1983 | Trutzschler | 19/111 |
| 4,759,102 | | 7/1988 | Verzilli et al. . | |
| 4,771,514 | * | 9/1988 | Verzilli | 19/111 |
| 4,945,609 | * | 8/1990 | Hauschild et al. | 19/109 |
| 4,996,746 | * | 3/1991 | Verzilli et al. | 19/111 |
| 5,259,092 | * | 11/1993 | Lambe et al. | 19/109 |

FOREIGN PATENT DOCUMENTS

| | | |
|---|---|---|
| 23 61 315 | 6/1975 | (DE) . |
| 714640 | 9/1954 | (GB) . |
| 2 053 994 | 2/1981 | (GB) . |

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A carding machine includes a main carding cylinder, a travelling flats assembly having a plurality of flat bars provided with a clothing cooperating with the clothing of the main carding cylinder; an endless flat bar driving element trained about end sprockets and circulating the flat bars in an endless path; a flat cleaning device supported at a location above the flat bar driving element and including a rotatably supported flat brush roller. A gearing is provided which has an input shaft connected to a power drive, a first output shaft connected to one of the end sprockets for circulating the flat bar driving element and a second output shaft connected to the flat brush roller for rotating the same. The first and second output shafts have a constant distance from one another.

7 Claims, 5 Drawing Sheets

GEARING FOR JOINTLY DRIVING FLAT BARS AND A FLAT BAR CLEANING DEVICE OF A CARDING MACHINE

CROSS REFERENCE TO RELATED APPLICATION

This application claims the priority of German Application No. 198 44 790.6 filed Sep. 30, 1998, which is incorporated herein by reference.

BACKGROUND OF THE INVENTION

This invention relates to a driving device for a carding machine having a travelling flats assembly and a flat brush roller (flat cleaning device) operatively connected to the flat bars which are circulated by an endless drive element supported on two end sprockets.

In a known driving device the two drives, that is, the drive for one of the end sprockets and the drive for the flat brush are derived by belts from the motor-driven main carding cylinder drive. In such an arrangement a special gearing is provided which has two worm gears, a bevel gear and several deflecting rollers. It is a disadvantage of the outlined conventional driving device that for each maintenance work the toothed belt drive has to be released and subsequently re-tensioned and further, it involves substantial technological outlay.

SUMMARY OF THE INVENTION

It is an object of the invention to provide an improved driving device of the above-outlined type, from which the discussed disadvantages are eliminated, which is structurally simple and which makes a simplified maintenance possible.

This object and others to become apparent as the specification progresses, are accomplished by the invention, according to which, briefly stated, the carding machine includes a main carding cylinder, a travelling flats assembly having a plurality of flat bars provided with a clothing cooperating with the clothing of the main carding cylinder, an endless flat bar driving element trained about end sprockets and circulating the flat bars in an endless path, a flat cleaning device supported at a location above the flat bar driving element and including a rotatably supported flat brush roller. A gearing is provided which has an input shaft connected to a power drive, a first output shaft connected to one of the end sprockets for circulating the flat bar driving element and a second output shaft connected to the flat brush roller for rotating the same. The first and second output shafts have a constant distance from one another.

The invention provides for a significant structural simplification since, in particular, the toothed belt drive together with several deflecting rollers is dispensed with, whereby a more economical manufacture and assembly is achieved. It is a further advantage of the invention that for maintenance work the toothed belt no longer needs to be released and re-tensioned to a new, predetermined precise value. Apart from these, simplifications a substantial reduction of the maintenance times and thus an increase of the productive periods are achieved.

The invention has the following additional advantageous features:

The gearing is axially rotatable about the axis of one of the end sprockets of the traveling flats assembly.

The gearing is insertable on the shaft of the end sprocket.

The traveling flats move slowly, about 200 mm/min and the flat brush rotates with an rpm of about 4–8.

A drive motor is coupled to the input of the gearing which is accommodated in a housing which, in turn, is rotatable about the axis of the end sprocket.

The housing of the flat cleaning device and the drive housing of the traveling flats are combined into a single housing.

DESCRIPTION OF THE PREFERRED EMBODIMENTS

Figure 1:
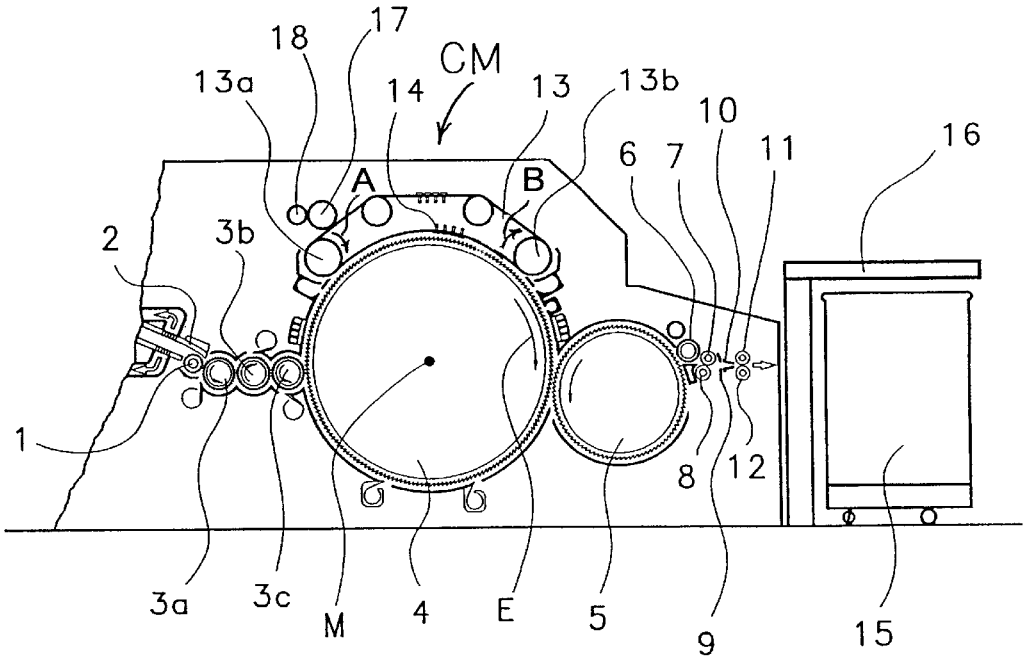
Fig. 1 (PRIOR ART)
FIG. 1 is a schematic side elevational view of a carding machine adapted to incoporate the invention.
Figure 2:
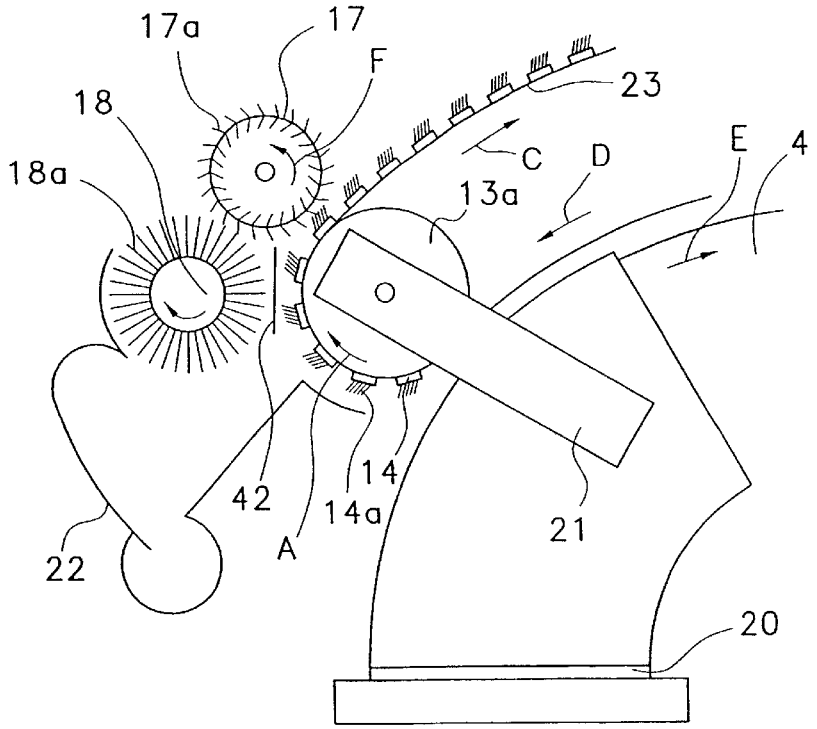
FIG. 2 is a schematic side elevational view of the flat cleaning device including a flat brush roller and a brush cleaning roller in the region of one of the end sprockets of the travelling flats assembly.

Turning to FIGS. 1 and 2, a carding machine CM is shown which may be an EXACTACARD DK 803 model manufactured by Trützschler GmbH & Co. KG, M önchengladbach, Germany. The carding machine CM has a feed roll 1, a feed table 2, licker-ins 3*a*, 3*b*, 3*c*, a main carding cylinder 4, a doffer 5, a stripping roll 6, crushing rolls 7, 8, a web guiding element 9, a sliver trumpet 10, calender rolls 11, 12, a travelling flats assembly 13 having flat bars 14, a coiler can 15 and a sliver coiler 16. The direction of rotation of the various rotary elements is indicated with curved arrows drawn therein. The rotary axis of the carding cylinder 4 is designated at M. The direction of rotation A, B of the frontal and rearward end sprockets 13*a* and 13*b* of the travelling flats assembly 13 is opposite to the rotary direction E of the carding cylinder 4. The flat bars 14 are drawn over a slide guide, in a forward direction as indicated by the arrow D, by an endless toothed driving belt 23 trained about the end sprockets 13*a* and 13*b*. The end sprockets 13*a* and 13*b* support the belt 23 for positioning the lower flight of the belt 23 adjacent a circumferential portion of the main carding cylinder 4 along a working zone of the flat bars 14 and for positioning an upper flight of the belt 23 above the lower flight along a return zone of the flat bars 14. On the upper side of the travelling flats assembly 13, opposite the slide guide, that is, along the return zone, the flat bars 14 are supported on the top face of returning flight (upper flight) of the toothed belt 23 and travel in the reverse direction as indicated by the arrow C.

With the clothings of the flat bars 14 a slowly rotating flat brush roller 17 is associated whose clothing is in contact with a rapidly rotating brush cleaning roller 18. The end sprocket 13*a* of the travelling flats and the flat brush roller 17 are driven by the output shafts of a joint drive whose input shaft is coupled with a drive motor.

A bracket 21 secured to the frame 20 of the carding machine supports the end sprocket 13*a*. A similar support is provided for the sprocket 13*b* at the opposite end of the travelling flats. The toothed belt 23 is trained about the two end sprockets 13*a* and 13*b* and conventionally entrains the flat bars 14 in an endless path. Removal of the flat strip from the flat bars 14*a* is effected by the flat brush roller 17 which has a clothing 17*a* formed of small hooks. At a flat bar velocity of, for example, 200 mm/min the flat brush roller 17 has an rpm of 6 (which corresponds to a circumferential speed of 2,564 mm/min for a brush roller diameter of 136 mm). The rotary brush cleaning roller 18 cleans the flat brush roller 17; the brush cleaning roller 18 has a clothing 18*a* situated at a small distance from the clothing of the flat brush roller 17. The brush cleaning roller 18 has an rpm of 1350 (which corresponds to a circumferential speed of 466.5 m/min for a roll diameter of 110 mm). Between the brush cleaning roller 18 and the flat bar clothings 14 a guard plate 42 is provided to prevent the dirt from being thrown on or between the flat bars 14. The brush cleaning roller 18 throws the removed dirt into a suction device 22.

Figure 3A:
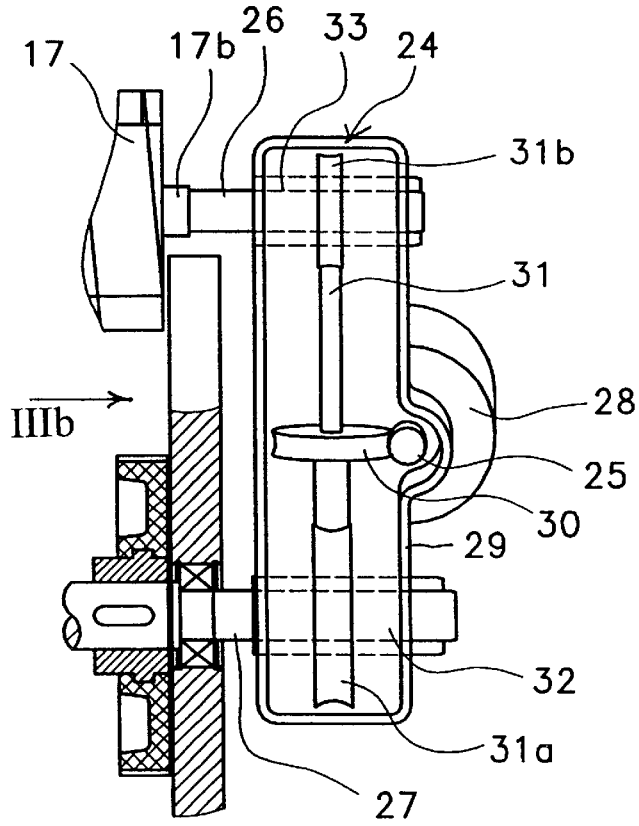
FIG. 3*a* is a schematic front elevational view of an insertable drive with drive motor and two output shafts coupled to an end sprocket of the travelling flats assembly and the flat brush roller.

Turning to FIG. 3*a*, the gearing 24 shown therein has an input shaft 25 and two output shafts 26 and 27. The gearing 24 is enclosed in a housing 29. The input shaft 25 is rotated by an electric motor 28. The output shaft 26 is coupled coaxially to the shaft 17*b* of the flat brush roller 17, while the output shaft 27 is coupled coaxially to the shaft 13*a*' of the end sprocket 13*a*. The distance between the two output shafts 26 and 27 is constant. A portion of the input shaft 25 is formed as a worm gear which meshes with a pinion 30 oriented at 90° to the input shaft 25 and mounted on a shaft 31. The two end portions of the shaft 31 are formed as worm gears 31*a*, 31*b* which cooperate with respective pinions 32 and 33 which, in turn, are mounted on respective output shafts 26 and 27.

Figure 3B:
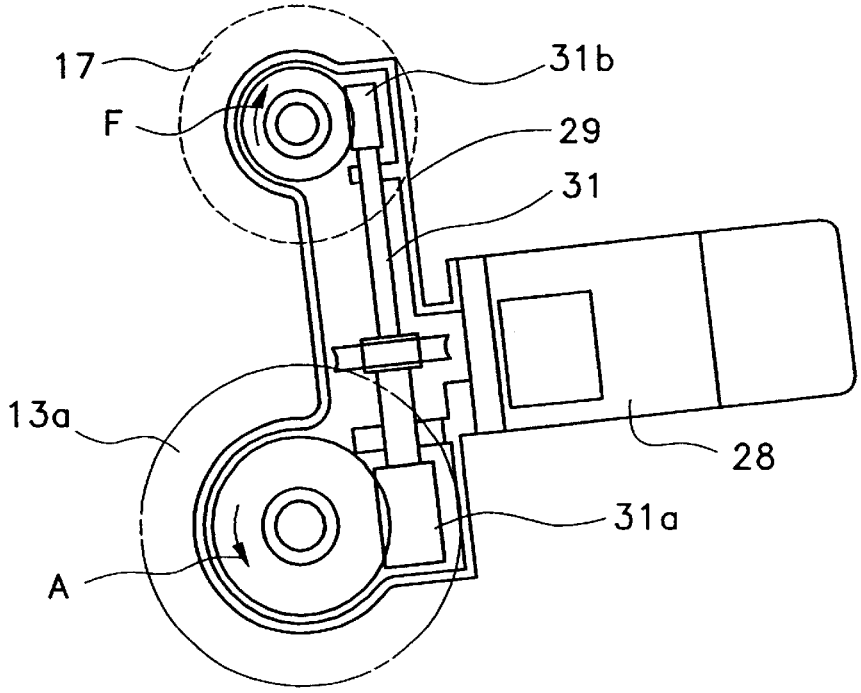
FIG. 3*b* is a side elevational view seen in the direction of the arrow IIIb of FIG. 3*a*.

As shown in FIG. 3*b*, the end sprocket 13*a* rotates in the direction A with an rpm of $n_1$ and the flat brush roller 17 rotates in the direction F with an rpm of $n_2$.

Figure 4:
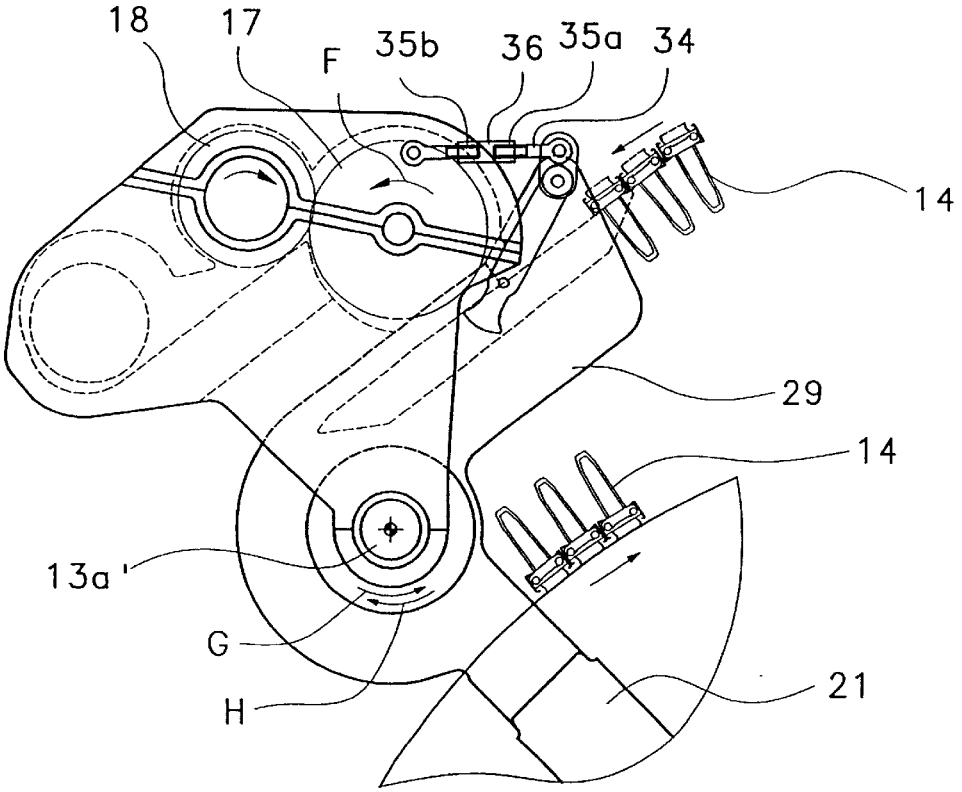
FIG. 4 is a side elevational view of a separate housing for the flat cleaning device, having a rotary axis in alignment with the rotary axis of an end sprocket of the travelling flats assembly.

Referring to FIG. 4, the housing 29 which accommodates the gearing 24, may be turned by a setting device 34 about the shaft 13*a*' of the sprocket 13*a* in the direction of the arrows G and H. The setting device 34 has two oppositely threaded screws 35*a*, 35*b* meshing with inner threads of a turnbuckle 36. The outer end of the screw 35*a* is secured to the machine frame while the outer end of the screw 35*b* is jointed to the housing 29. By rotating the turnbuckle 36 in the one or the other direction, the housing 29 is turned about the axis 13*a*' so that the flat brush roller 17 is moved towards or away from the flat bars 14.

It is noted that the embodiment illustrated in FIG. 4 may also be secured stationarily, that is, without the setting device 34 and without the rotatability of the housing 29 about the axis 13*a*'.

Figure 5:
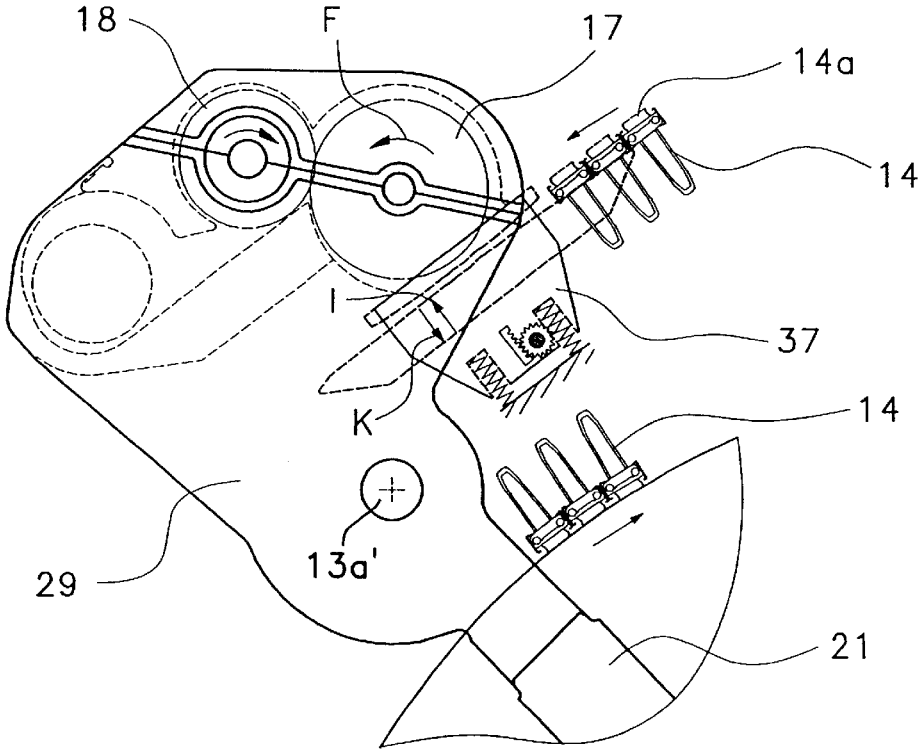
FIG. 5 is a side elevational view of a combined housing for the drives of the flat cleaning device and the travelling flats assembly.

In the construction shown in FIG. 5, the housing 29 and the housing containing the drive for the flat bars are combined into a single, stationarily supported housing. A belt shifting device 37 is arranged on that side of the toothed belt 23 which is oriented away from the flat bars 14 for locally shifting the toothed belt 23, together with the flat bars 14, in the direction of the arrows I, K. The location where such a belt shift takes place is downstream of the sprocket 13*a* as viewed in the direction C of belt travel. Thus, in case the flat brush roller 17 is stationarily (that is, non-shiftably) mounted, the toothed belt 23, together with the flat bars 14 may be lifted for a desired period of time toward the flat brush roller 17 in such a manner that in the region of the flat brush roller 17 the clothing 17*a* of the flat brush roller 17 is in engagement with the dirt strip (not shown) in the flat bar clothing 14*a*.

Figure 6A:
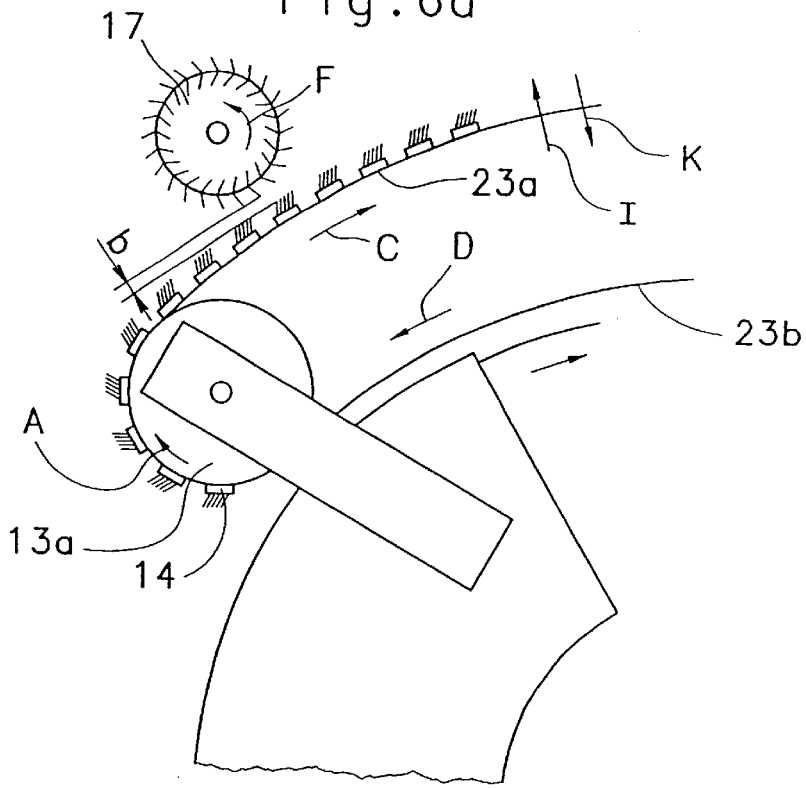
FIG. 6*a* is a side elevational view similar to FIG. 2, showing an embodiment in which the flat brush roller is stationary and the flat bar driving belt is, with the flat bars movable towards and away from the flat brush, wherein the flat brush roller is shown out of engagement with the flat bar clothings.
Figure 6B:
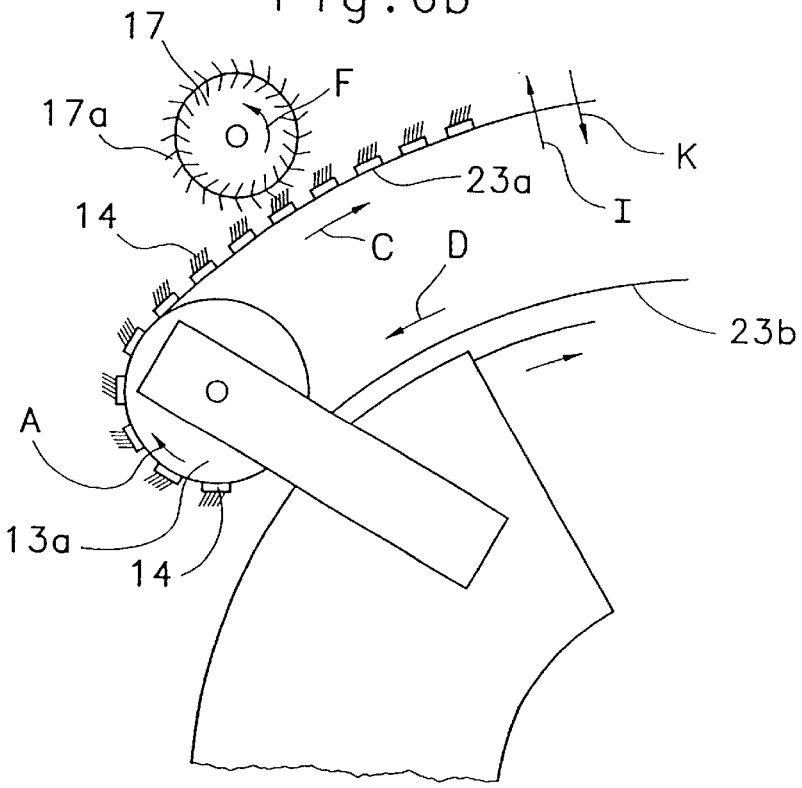
FIG. 6*b* is a view similar to FIG. 6*a*, showing the flat brush roller in engagement with the flat bar clothings.

In FIG. 6*a* between the points of the clothings 17*a* of the stationary flat brush roller 17 and the points of the clothings 14*a* of the flat bars 14 a clearance b is present, that is, the clothings 17*a* and 14*a* are out of engagement with one another. In accordance with FIG. 6*b* the toothed belt 23 with the flat bars 14—as compared to FIG. 6a—are shifted in the direction I locally to such an extent that the clothings 14*a* and 17*a* are in engagement with one another. In operation, the flat brush roller 17 rotates in the direction F and the upper flight (return flight) 23*a* of the toothed belt 23 travels in the direction C. while the lower flight 23*b* travels in the direction D As a result, the different circumferential portions of the clothings 17*a* of the flat brush roller 17 engage consecutively the clothing 14*a* of consecutive flat bars 14 and remove the dirt therefrom.

Figure 7A:
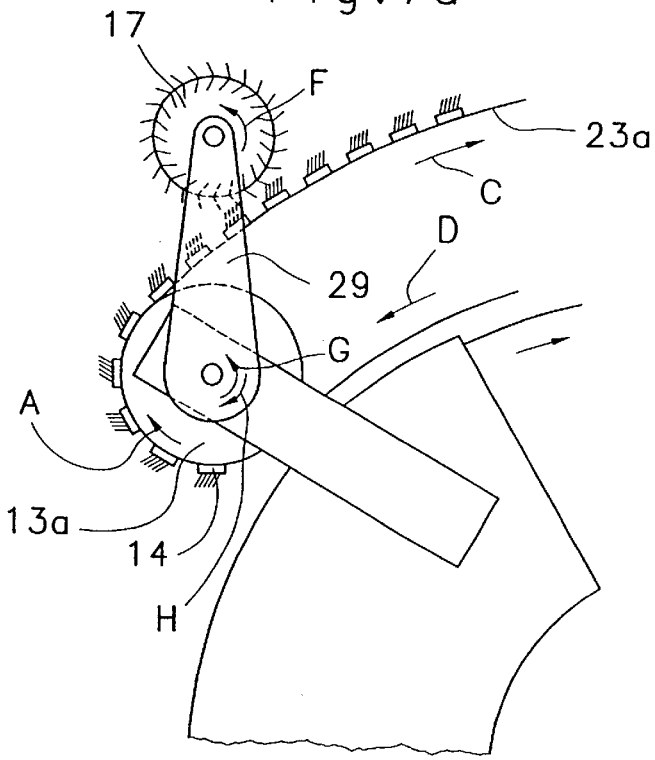
FIG. 7*a* is a side elevational view of a preferred embodiment of the invention, wherein the flat brush roller is pivotal toward and away from the flat bars, illustrated in an operative, engagement position.

In FIG. 7*a* the housing 29, together with the flat brush roller 17, was turned clockwise in the direction H to such an extent about the axis of the end sprocket 13*a* that the clothings 14*a* of the flat bars 14 engage into the clothing 17*a* of the flat brush roller 17. The cleaning operation is identical to that described in connection with FIG. 6*b*.

Figure 7B:
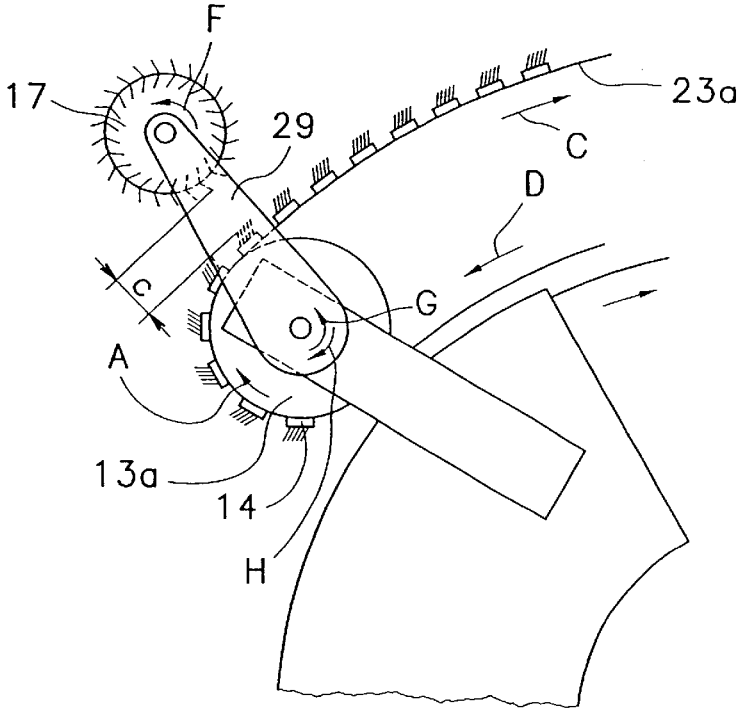
FIG. 7*b* is a view similar to FIG. 7*a*, showing the flat brush roller in an inoperative position in which it is out of engagement with the flat bars.

In FIG. 7*b* the housing 29, together with the flat brush roller 17, was turned counterclockwise in the direction G to such an extent about the axis of the end sprocket 13*a* that the clothing 14*a* of the flat bars 14 is at a clearance c from the points of the clothing 17*a*.

It will be understood that the above description of the present invention is susceptible to various modifications, changes and adaptations, and the same are intended to be comprehended within the meaning and range of equivalents of the appended claims.

What is claimed is:

1. In a carding machine including a main carding cylinder having a clothing;

a travelling flats assembly having a plurality of flat bars having a clothing cooperating with the clothing of the main carding cylinder;

an endless flat bar driving element trained about end sprockets and circulating the flat bars in an endless path; and a flat cleaning device supported at a location above the flat bar driving element and including a rotatably supported flat brush roller;

the improvement comprising a gearing having (a) an input shaft connected to a power drive;

(b) a first output shaft connected to one of said end sprockets for circulating said flat bar driving element;

(c) a second output shaft connected to said flat brush roller for rotating said flat brush roller; said first and second output shafts having a constant distance from one another; and (d) coupling means for connecting said input shaft to said first and second output shafts to rotate said first and second output shafts by said input shaft.

2. The carding machine as defined in claim 1, further comprising means for mounting said gearing assembly for rotation about a rotary axis of said one end sprocket.

3. The carding machine as defined in claim 1, wherein said gearing is insertable on and removable from said one end sprocket and said flat brush roller.

4. The carding machine as defined in claim 1, further comprising a housing accommodating said gearing.

5. The carding machine as defined in claim 4, wherein said housing is rotatable with said gearing as a unit about said rotary axis.

6. The carding machine as defined in claim 5, wherein said power drive is a drive motor attached to said housing and rotatable therewith as a unit.

7. The carding machine as defined in claim 1, wherein said coupling means includes (a) a first gear affixed to said input shaft;

(b) a second gear affixed to said first output shaft;

(c) a third gear affixed to said second output shaft; and (d) a coupling shaft carrying a fourth gear meshing with said first gear, a fifth gear meshing with said second gear and a sixth gear meshing with said third gear.

* * * * *